US010984685B1

(12) United States Patent
Kempisty

(10) Patent No.: US 10,984,685 B1
(45) Date of Patent: Apr. 20, 2021

(54) INDUSTRIAL REINFORCEMENT FOR A WEARABLE IDENTIFICATION

(71) Applicant: Mitchell Kempisty, Monterey, CA (US)

(72) Inventor: Mitchell Kempisty, Monterey, CA (US)

( * ) Notice: Subject to any disclaimer, the term of this patent is extended or adjusted under 35 U.S.C. 154(b) by 0 days.

(21) Appl. No.: 16/884,486

(22) Filed: May 27, 2020

(51) Int. Cl.
*G09F 21/02* (2006.01)
*G09F 3/20* (2006.01)
*A44C 3/00* (2006.01)

(52) U.S. Cl.
CPC ..... *G09F 3/207* (2013.01); *G09F 21/023* (2020.05); *A44C 3/001* (2013.01)

(58) Field of Classification Search
CPC ..... G09F 3/207; G09F 21/023; A44C 3/001
See application file for complete search history.

(56) References Cited

U.S. PATENT DOCUMENTS 4,988,338 A * 1/1991 Taylor ..... A61M 5/1418 604/180
5,189,737 A * 3/1993 Ribicic ..... A41D 13/00 2/81
5,604,961 A * 2/1997 Cole ..... A44B 18/00 24/306
5,864,925 A * 2/1999 McGee ..... A63B 57/00 24/3.11
6,339,866 B1 * 1/2002 French ..... A41D 27/08 2/195.1
6,568,981 B1 * 5/2003 Chang ..... A63H 33/048 24/306
7,963,004 B2 * 6/2011 Cho ..... A44C 3/001 24/3.1
8,146,209 B2 * 4/2012 Carnate ..... A45C 13/00 24/3.1
8,245,362 B2 * 8/2012 Blevins ..... A63B 55/408 24/298
8,701,216 B1 * 4/2014 Evans ..... A41D 19/0037 2/161.2
2004/0166282 A1 * 8/2004 Kingsford ..... A44B 18/0023 428/95
2005/0104357 A1 * 5/2005 Olson ..... B60R 22/00 280/801.1
2005/0217087 A1 * 10/2005 Gallant ..... A44B 18/0061 24/452
2007/0043311 A1 * 2/2007 Jaggan-Vince ..... A61F 5/3746 602/4

(Continued)

*Primary Examiner* — Cassandra Davis
(74) *Attorney, Agent, or Firm* — Perkins Coie LLP; Michael A. Glenn

(57) ABSTRACT

Presented here is a method and system to prevent wrinkling of the wearable identification (ID) by providing a reinforcement to the wearable ID. The reinforcement can act as an interface between the wearable ID and the uniform by attaching to the wearable ID as well as to the uniform. The wearable ID can be detached from the reinforcement, and the reinforcement can be detached from the uniform. The reinforcement can include a hook-and-loop hook on one side and a hook-and-loop loop on the other side to enable attachment between the wearable ID and the uniform. The reinforcement can be made of material that is sufficiently strong to resist wrinkling, but sufficiently flexible to be able to bend in response to an applied force without breaking. Further, the reinforcement material can be fire retardant.

18 Claims, 8 Drawing Sheets

(56) References Cited

U.S. PATENT DOCUMENTS

| | | | | |
|---|---|---|---|---|
| 2008/0039755 | A1* | 2/2008 | Phillips | A61F 5/0104 602/20 |
| 2010/0024173 | A1* | 2/2010 | Cho | G09F 7/12 24/3.1 |
| 2013/0097834 | A1* | 4/2013 | Pacione | E04F 15/02194 29/402.08 |
| 2013/0160250 | A1* | 6/2013 | Lecluyse | A44B 18/0069 24/444 |
| 2014/0044910 | A1* | 2/2014 | Shi | B32B 7/12 428/41.7 |

* cited by examiner

INDUSTRIAL REINFORCEMENT FOR A WEARABLE IDENTIFICATION

TECHNICAL FIELD

The present application is related to industrial reinforcement for a wearable identification, and more specifically to methods and systems that act as an interface between the wearable identification and a clothing item.

BACKGROUND

In an industrial setting, such as on a ship, personnel may wear uniforms with identifications, such as nametags, temporarily attached to the uniforms. The wearable identifications can be made of cloth and can be attached to uniforms using hook-and-loop, such as Velcro. Exposed to the physical forces of the industrial setting, the wearable identifications can wrinkle and make the uniform appear unkempt. The wrinkling can happen due to demanding manual labor and tough treatment of the uniform while it is worn, taken on/off the ship, stored poorly, and/or rolled down and tied around the waist.

SUMMARY

Presented here is a method and system to prevent wrinkling of the wearable identifications (ID) by providing a reinforcement to the wearable ID. The reinforcement can act as an interface between the wearable ID and the uniform by attaching to the wearable ID as well as to the uniform. The wearable ID can be detached from the reinforcement, and the reinforcement can be detached from the uniform. The reinforcement can include a hook-and-loop hook on one side and a hook-and-loop loop on the other side to enable attachment between the wearable ID and the uniform. The reinforcement can be made of material that is sufficiently strong to resist wrinkling of the wearable ID material, but sufficiently flexible to be able to bend without breaking in response to an applied force. Further, the reinforcement material can be fire retardant.

DETAILED DESCRIPTION

Industrial Reinforcement for a Wearable ID

Presented here is a system and method to prevent wrinkling of wearable identifications (ID) by providing a reinforcement to the wearable ID. The reinforcement can act as an interface between the wearable ID and the uniform by attaching to the wearable ID as well as to the uniform. The wearable ID can be detached from the reinforcement, and the reinforcement can be detached from the uniform. The reinforcement can include a hook-and-loop hook on one side and a hook-and-loop loop on the other side to enable attachment between the wearable ID and the uniform. The hook and loop can be a Velcro fastener. The reinforcement can be made of material that is sufficiently strong to resist wrinkling, but sufficiently flexible to be able to bend in response to a transverse load without breaking. In other words, the reinforcement is designed to flex when a load perpendicular to the lateral axis is applied. Further, the reinforcement material can be fire retardant.

Figure 1A:
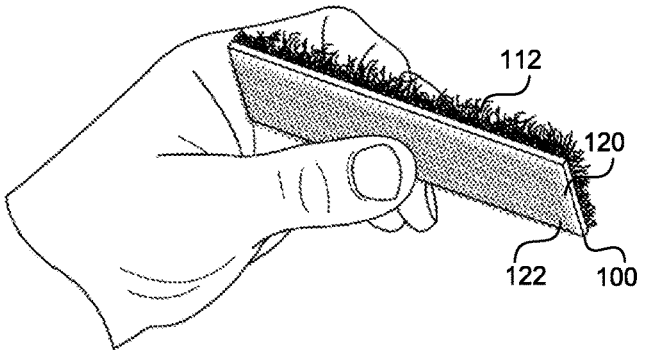
FIGS. 1A-1D show a detachable reinforcing member that can attach to a wearable identification, such as a nametag.
Figure 1B:
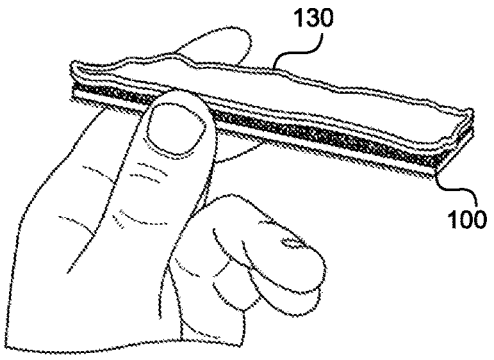
Figure 1C:
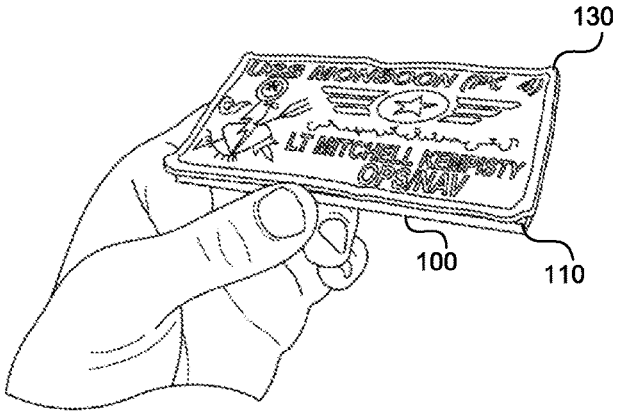

FIGS. 1A-1D show a detachable reinforcing member that can attach to a wearable ID. FIG. 1A shows a reinforcing member, i.e., a planar interface member, 100 that can be made of a fire-resistant material. The fire-resistant material can be a polylactic acid (PLA), or a thermoplastic material that meets the UL-94 standards for fire retardant materials, such as the 5V standards. An example of such a thermoplastic material is a fire-resistant polycarbonate. UL-94, the Standard for Safety of Flammability of Plastic Materials for Parts in Devices and Appliances testing, is a plastics flammability standard released by Underwriters Laboratories of the United States. In some embodiments, the reinforcing member 100 can be made out of a flammable material and treated with a fire retardant chemical to prevent burning. Even if the reinforcing member 100 is made out of the fire retardant material, the reinforcing member 100 can be treated with the fire retardant chemicals.

Figure 1D:
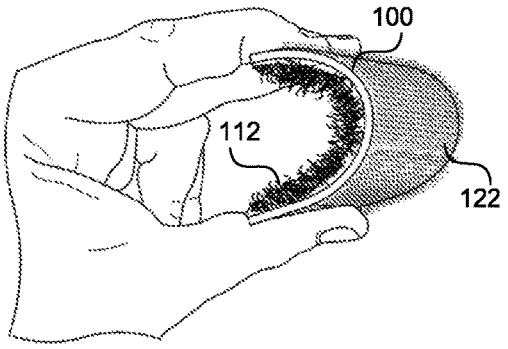

The reinforcing member 100's idealized flexural rigidity of 9.5900 kN-mm^2 provides a unique combination of flexibility and rigidness to be strong enough to resist wrinkling of the wearable ID 130, but also allow flexibility for user comfort. In other words, the reinforcing member 100 can resist wrinkling which is a high-frequency deformation, involving multiple points of bending, but to prevent breaking, the reinforcing member 100 can bend, i.e., deform at one point, as shown in FIG. 1D. Idealized flexural rigidity is determined using an average value of Young's modulus (E)=2.3500 kN/mm^2 for fire resistant polycarbonate materials and a mathematically determined moment of inertia (I)=4.0827 mm^4 based on the reinforcing member's cross-sectional dimensions.

Figure 2A:
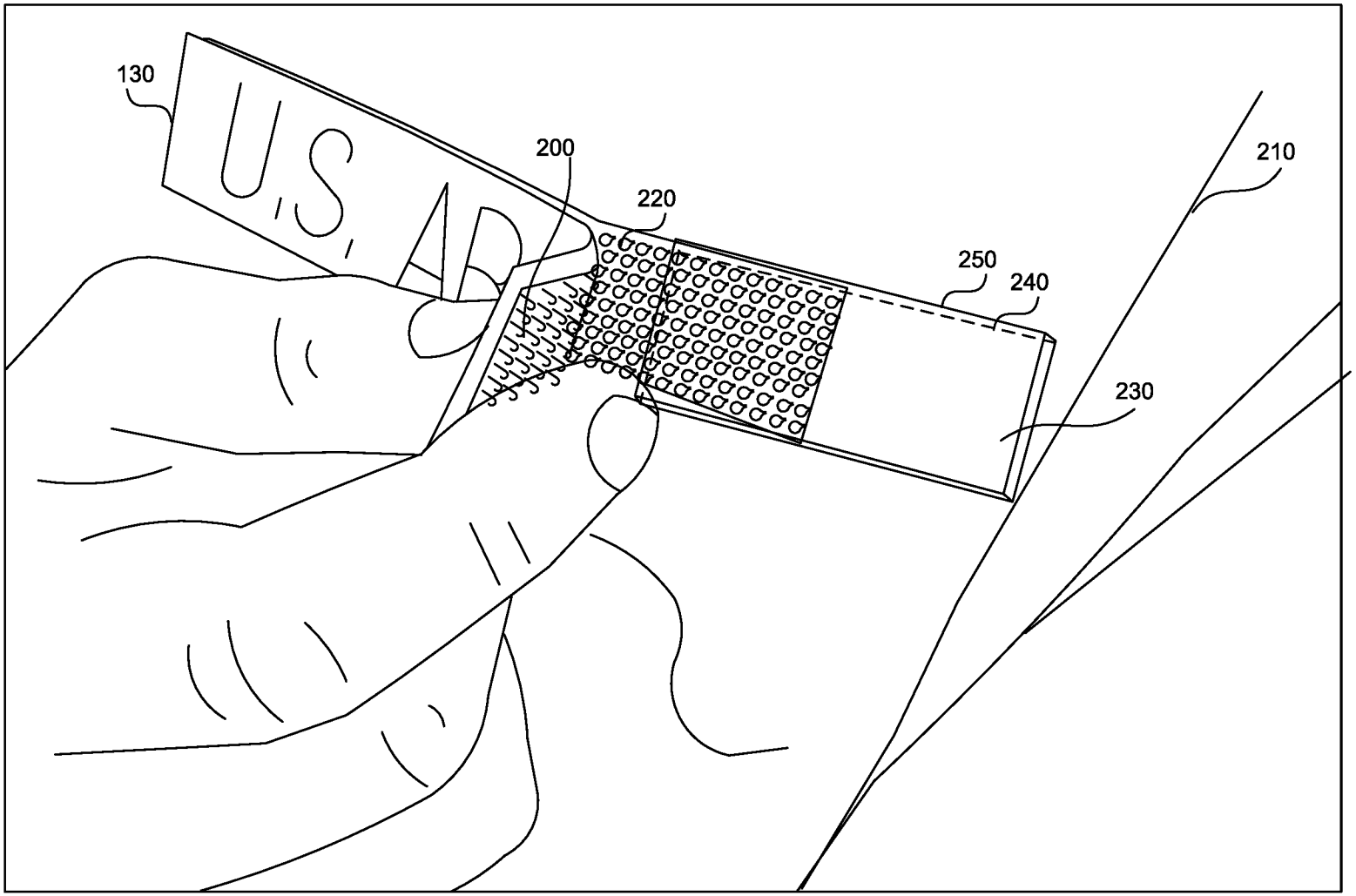
FIGS. 2A-2B show a reinforcing member acting as an interface between a wearable identification and a clothing item, such as a uniform.

A first attachment member 112 can form a first attachment when in contact with a first attachment member receiver 200 in FIG. 2A. The first attachment member 112 can be attached to a first side 110 of the reinforcing member 100 or can be housed inside the reinforcing member 100. The first attachment can support or resist a vertical force of up to 44 N, such as supporting a weight of a wearable ID 130 against gravity. The first attachment member 112 can be a part of a hook-and-loop attachment mechanism including a hook and loop. Additionally, the first attachment member 112 can be a magnet, a protrusion or an indentation enabling attachment to a corresponding magnet, indentation or protrusion, respectively. The first attachment member 112 can be a detachable hook-and-loop sticker, or a detachable part of an attachment mechanism such as a detachable magnet, detachable protrusion and/or a detachable indentation.

The second attachment member 122 can form a second attachment in contact with a second attachment member receiver 220 in FIG. 2A, the second attachment capable of supporting or resisting a vertical force of up to 44 N including the reinforcing member 100, the first attachment member 112, the second attachment member 122 and the wearable ID 130 against an applied vertical force. The second attachment member 122 can be attached to a second side 120 of the reinforcing member 100 or can be housed inside the reinforcing member 100. The second attachment member 122 can be a part of a hook-and-loop attachment mechanism including the hook and loop. Similarly, to the first attachment member 112, the second attachment member 122 can be a magnet, a protrusion or an indentation enabling attachment to a corresponding magnet, indentation or protrusion, respectively. The second attachment member 122 can be a detachable hook-and-loop sticker, or a detachable part of an attachment mechanism such as a detachable magnet, detachable protrusion and/or a detachable indentation. When the first attachment member 112 and the second attachment member 122 are in contact with each other, they can form an attachment, such as a hook-and-loop attachment, a magnetic attachment, protrusion/indentation attachment, etc.

Similar to the reinforcing member 100, the first attachment member 112 and the second attachment member 122 can be made out of a fire resistant material and/or can be treated with a fire retardant chemical.

The first and the second attachment members, 112 and 122 can be a first and a second attachment surface associated with the reinforcing member, i.e., the planar interface member, 100.

Figure 2B:
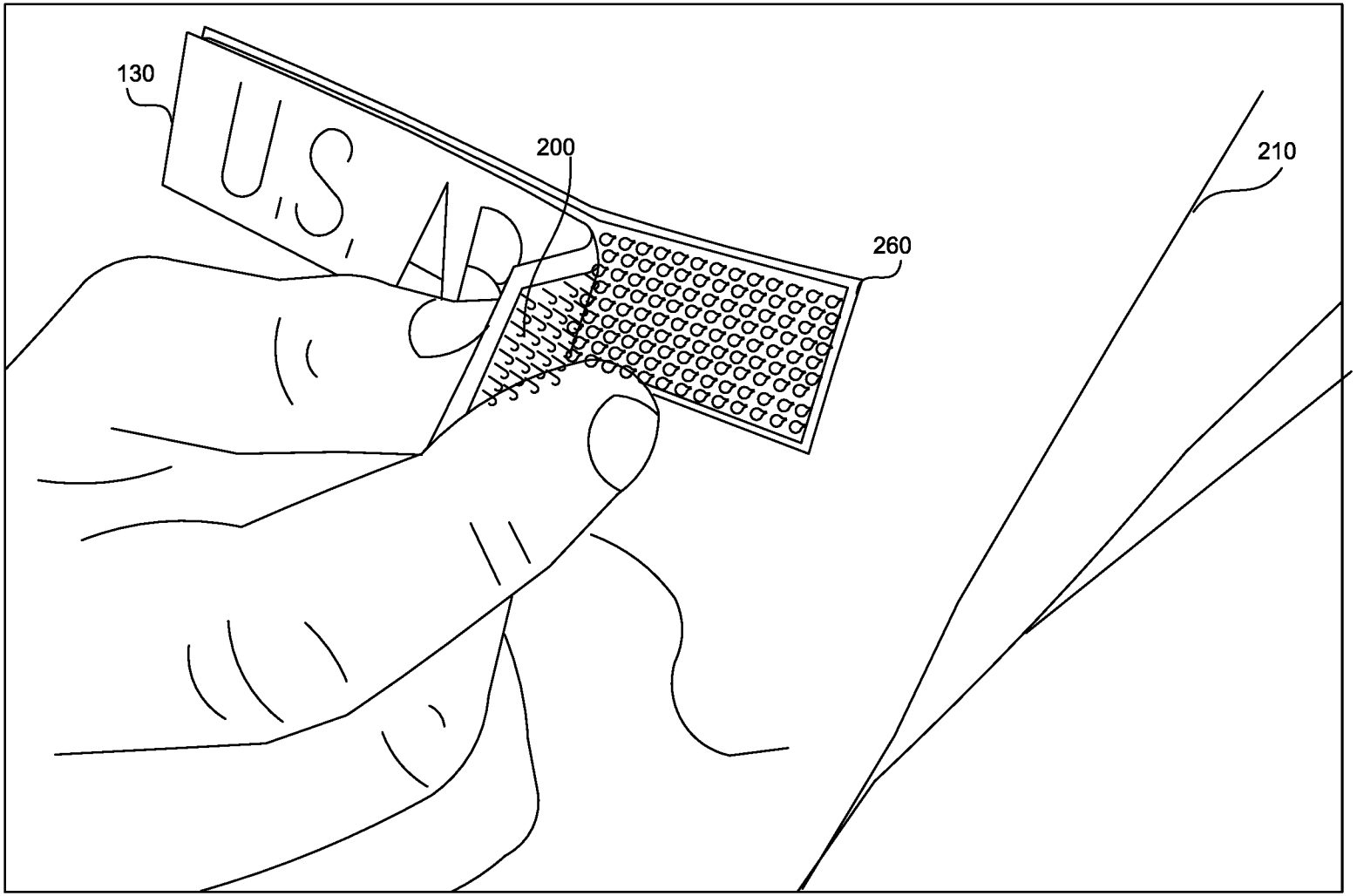

FIGS. 2A-2B show the reinforcing member acting as an interface between a wearable ID and a clothing item, such as a uniform. The wearable ID 130 can have a first attachment member receiver 200 which attaches to the first attachment member 112 in FIGS. 1A-1D. If the attachment member 112 is a hook-and-loop loop, the first attachment member receiver 200 is a hook-and-loop hook.

The first and second attachment members/surfaces 112, 122 in FIGS. 1A-1D can enable temporary mating engagement with a garment 210, and the wearable ID, i.e., a label, 130. The second attachment surface 122 can be substantially opposite the first attachment surface 112. The perimeter of the reinforcing member 250 can be substantially coincident with a label perimeter.

The reinforcing member 250 can be detachable or can be attached to a clothing item, such as the uniform 210. The reinforcing member 250 can be interposed between the wearable ID 130 and the garment 210 to detachably and rigidly secure the wearable ID 130 to the garment 210. FIG. 2A shows a detachable reinforcing member 250. The wearable ID 130 and the garment 210 can include an attachment mechanism 200, 220 for temporary mating engagement, one with the other.

The reinforcing member 250 can attach to the wearable ID 130 using a first attachment mechanism of the surface 230 and can attach to the uniform 210 using a second attachment mechanism of the surface 240. The second attachment mechanism of the surface 240 can connect to second attachment member receiver 220 of the uniform 210, which attaches to the second attachment member 122 in FIGS. 1A-1D. The first attachment mechanism and the second attachment mechanism can attach to each other, such as two corresponding parts of a hook-and-loop or two corresponding parts of a magnet, however the first and second attachment mechanism need not attach to each other. For example, both the first and the second attachment mechanism can be hook-and-loop loops, or the first attachment mechanism can be magnetic, while the second attachment mechanism can be hook-and-loop.

FIG. 2B shows the reinforcing member 260 permanently attached to the clothing item 210. The reinforcing member 260 can be permanently affixed to the uniform 210 using an attachment mechanism such as sewing or gluing.

Figure 3:
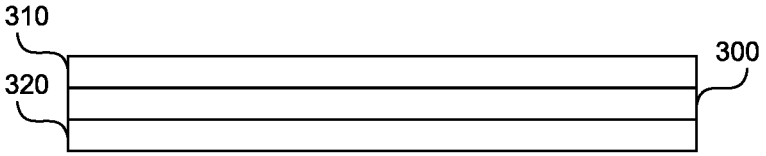
FIG. 3 is a cross-section of a reinforcing member with two attachment members.

FIG. 3 is a cross-section of the reinforcing member with two attachment members. The reinforcing member 300 can have two attachment members 310, 320.

The attachment member 310 can attach to an object weighing up to 10 lbs, creating a downforce of up to 44 N, such as a wearable ID 130 in FIGS. 1A-1C, 2A-2B. The attachment member 310 can be a part of a detachable attachment mechanism such as hook-and-loop, magnets, protrusions, and/or indentations. The attachment members 310 can wholly or partially cover a face of the reinforcing member 300.

The attachment member 320 can attach to the clothing item 210 in FIGS. 2A-2B in a detachable or a permanent manner. The attachment member 320 can wholly or partially cover a face of the reinforcing member 300. The attachment member 320 can be a part of an attachment mechanism such as sewing, gluing, hook-and-loop, magnets, protrusions, and/or indentations, and can support or resist a vertical force of up to 44 N.

Figure 4A:
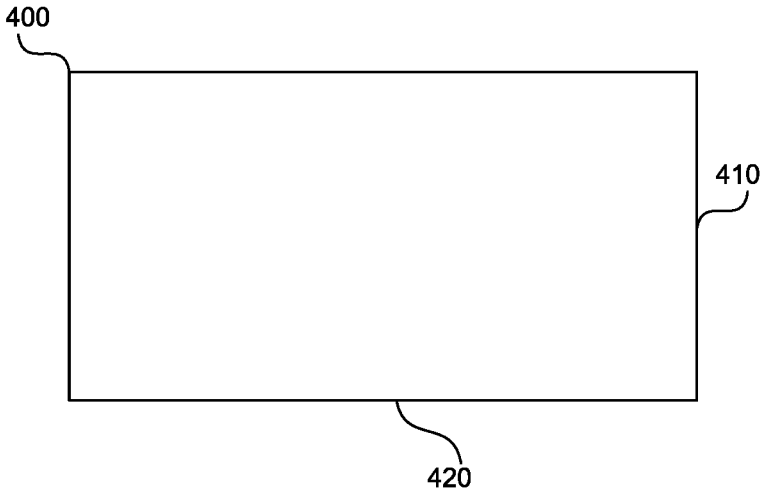
FIGS. 4A-4B show a front view and a side view of a reinforcing member, respectively.
Figure 4B:
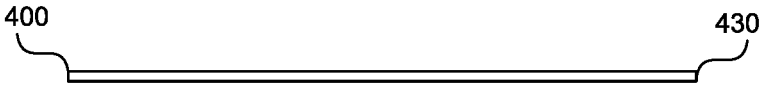

FIGS. 4A-4B show a front view and a side view of the reinforcing member, respectively. The depth 410 of the reinforcing member 400 can vary between 45 mm and 55 mm, preferably 52 mm. The width 420 of the reinforcing member 400 can vary between 90 mm and 105 mm, preferably 97.5 mm. The height 430 of the reinforcing member 400 can vary between 0.6 mm and 2 mm, preferably between 0.9 mm and 1.2 mm. The reinforcing member 400 can be manufactured using a 3D printer or other additive manufacturing method.

Figure 4C:
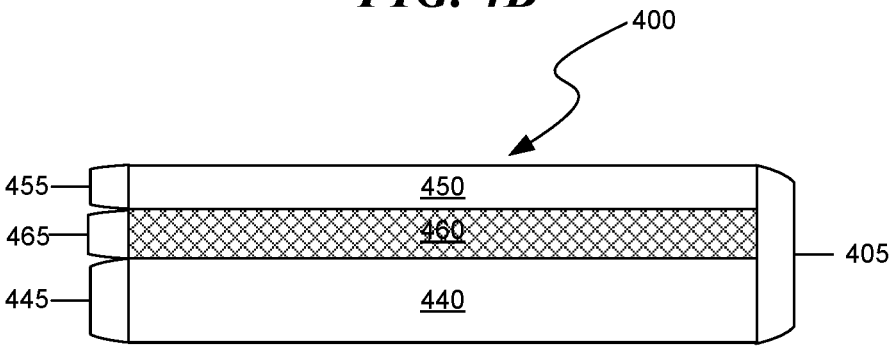
FIG. 4C shows a cross-section of the reinforcing member.
Figure 5A:
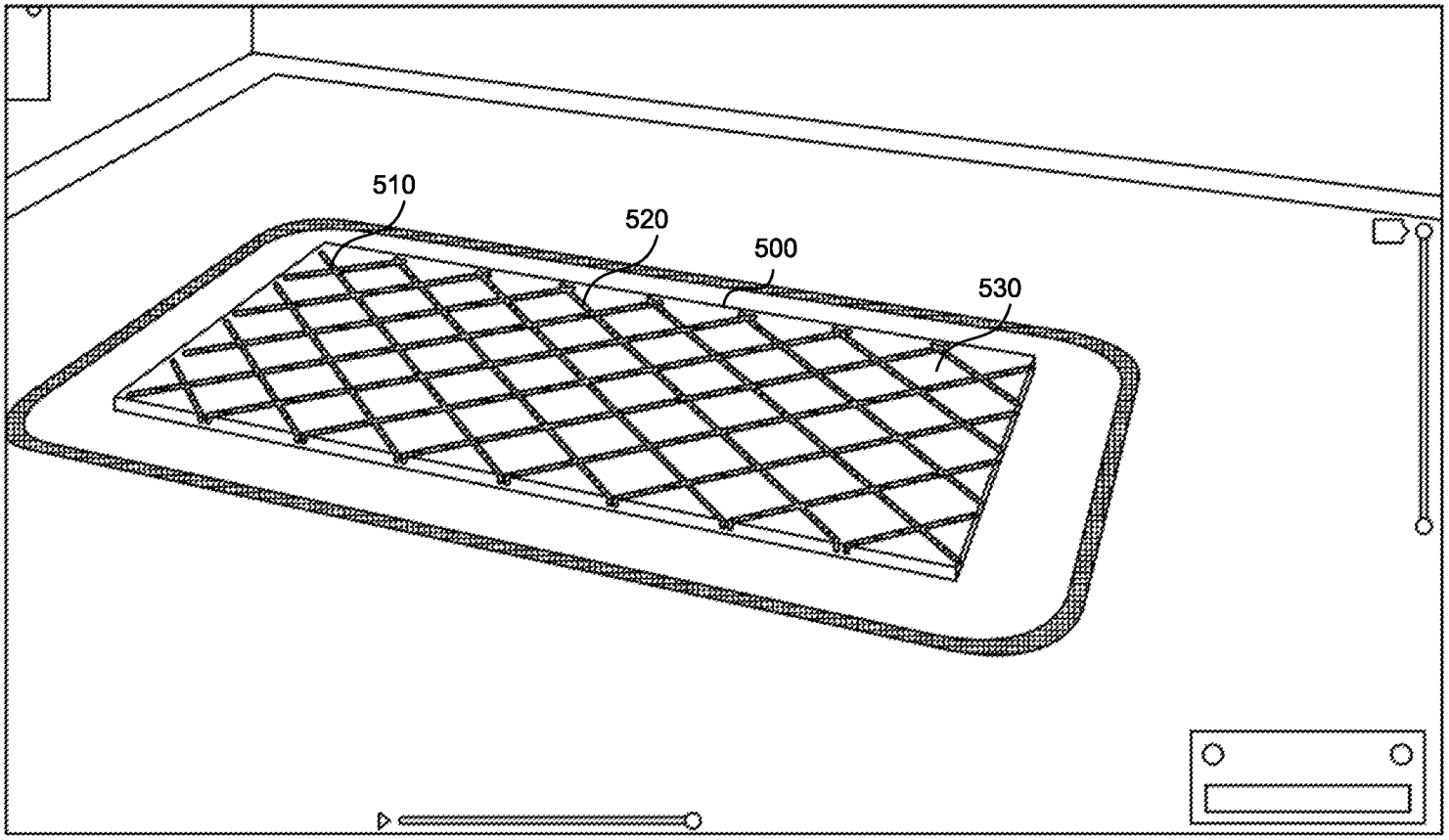
FIGS. 5A-5B show an internal structure of the reinforcing member.
Figure 5B:
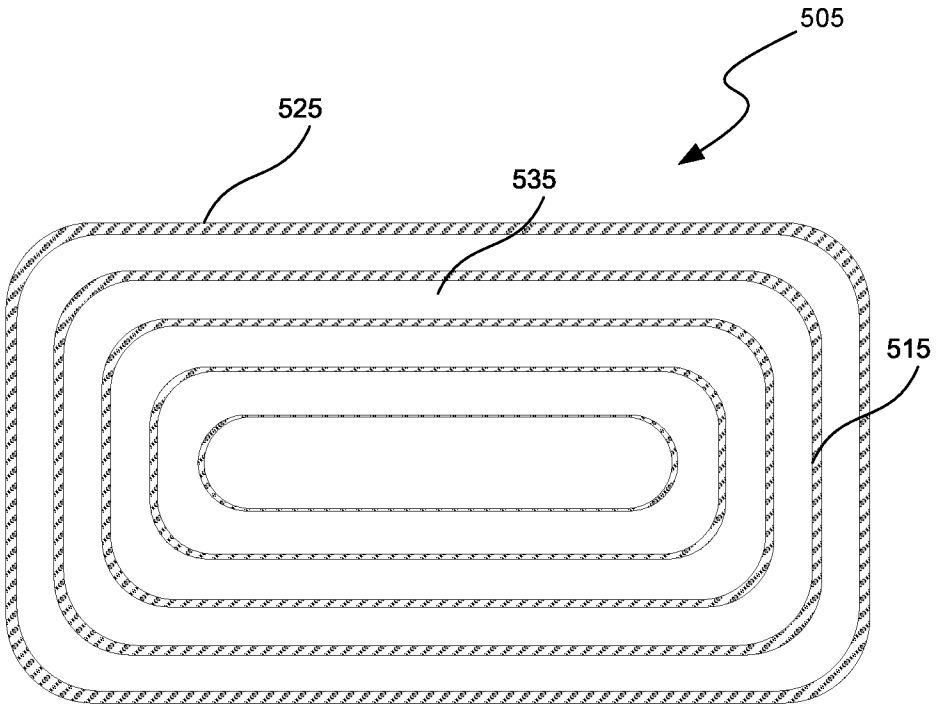

FIG. 4C shows a cross-section of the reinforcing member. The reinforcing member 400 can have 2 parts 440, 450 that are solid, and a middle part 460 that is partially hollow on the inside and has a reinforcing pattern, such as an infill, defining indentations and protrusions, as shown in FIGS. 5A-5B. The 2 parts 440, 450 can be substantially the same height. In some embodiments, the 2 heights 445 and 455 can be different. For example, the height that is closer to the body, e.g., height 445, can be thicker than height 455.

The height 465 of the reinforcing pattern middle part 460 can vary between 30% and 50% of the total height 405 of the reinforcing member 400. For example, when the total height 405 is 1 mm, the height 465 of the middle part 460 can be 0.3 mm, while the heights 445 and 455 can be 0.4 mm and 0.3 mm, respectively.

FIGS. 5A-5B show an internal structure of the reinforcing member. The reinforcing member 500, 505 can be a solid piece of material having dimensions as described in FIGS. 4A-4B. The reinforcing member 500, 505 can be partially hollow inside and have a reinforcing pattern 510, 515 such as an infill, defining indentations and protrusions, as shown in FIGS. 5A-5B, inside the reinforcing member 500, 505. The reinforcing pattern 510, 515 can be a crisscross pattern, as shown in FIG. 5A or, preferably, can be a concentric pattern, as shown in FIG. 5B. The reinforcing pattern 510, 515 can include curvilinear shapes such as ellipses, sinusoidal curves, etc., and/or rectilinear shapes such as triangles, quadrilaterals, pentagons, hexagons, etc. The reinforcing pattern 510, 515 can be printed inside the reinforcing member 500, 505.

The reinforcing pattern 510, 515 serves to improve the values of the curvature and flexural rigidity of the reinforcing member 500, 505. Specifically, the reinforcing pattern 510, 515 can increase the curvature of the reinforcing member 510, 515 while decreasing flexural rigidity. In other words, the reinforcing pattern 510, 515 enables the reinforcing member 500, 505 to bend in response to a force, as shown in FIG. 1D, as opposed to breaking. The density of the reinforcing pattern 510, 515 can vary producing a trade-off between flexural properties of the reinforcing member 500, 505 such as flexural rigidity versus the ability to bend. The more protrusions 520, 525 and/or the wider the protrusions 520, 525 the higher the rigidity of the reinforcing member 500, 505, while the more indentations 530, 535 and/or the wider the indentations 530, 535, the higher the ability to bend. Higher flexural rigidity can increase the toughness of the reinforcing member 500, 505, by making it harder to bend. Higher flexural rigidity can also lower the maximum curvature of the reinforcing member 500, 505.

The reinforcing pattern 510, 515 can also increase the flexibility and maximum curvature of the reinforcing member 500, 505, while reducing the quantity of material needed to create the reinforcing member 500, 505. For example, the reinforcing pattern 510, 515 can consume as little as 5% of the material compared to a solid piece of material having the same dimensions. The density of the reinforcing pattern 510, 515 can vary producing a trade-off between flexural properties of the reinforcing member 500, 505 and the amount of material needed to manufacture the reinforcing pattern 510, 515. The more protrusions 520, 525 and/or the wider the protrusions 520, 525 the higher the flexural rigidity of the reinforcing member 500, 505, while the more indentations 530, 535 and/or the wider the indentations 530, 535, the lower the quantity of material needed to create the reinforcing member 500, 505.

Figure 6A:
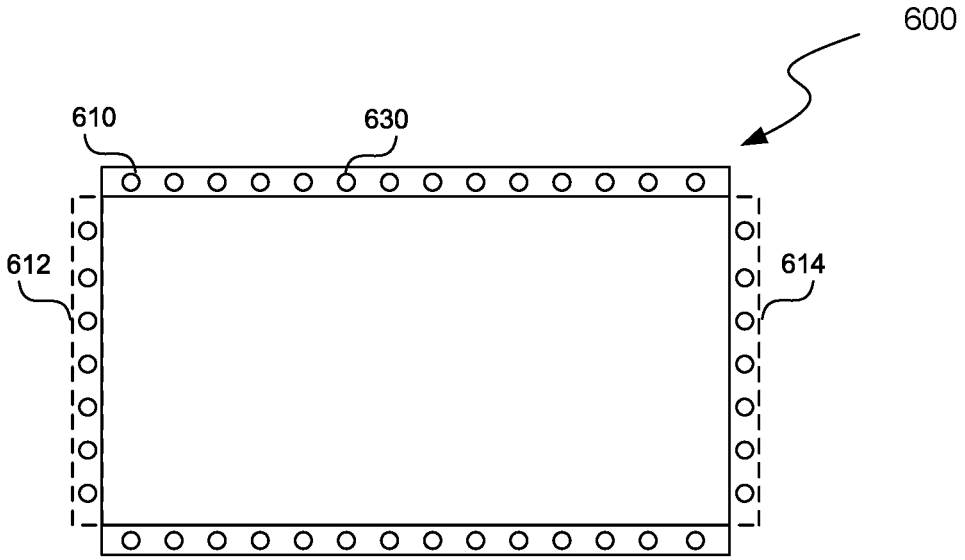
FIGS. 6A-6B show an attachment member to attach a reinforcing member to a clothing item.
Figure 6B:
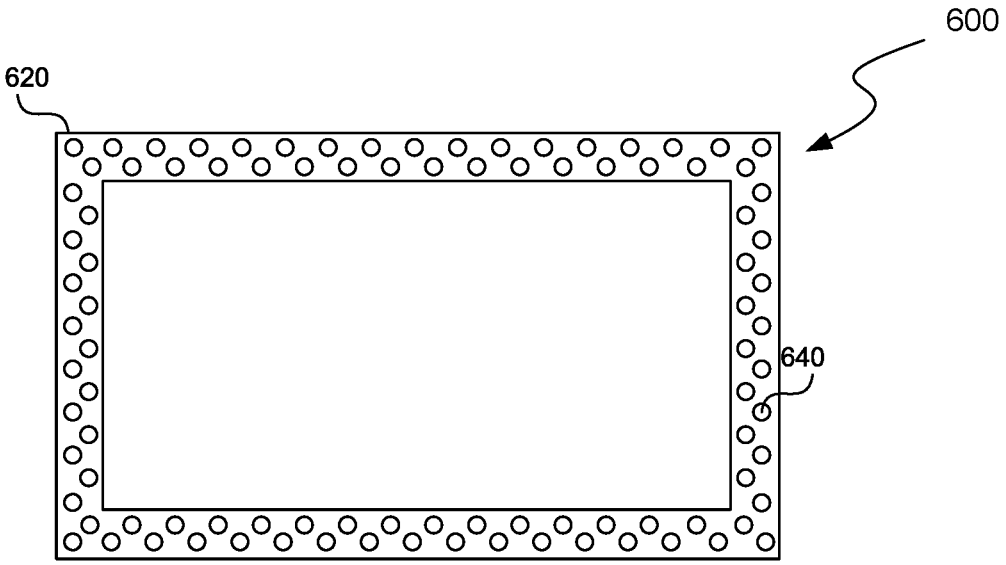

FIGS. 6A-6B show an attachment member to attach the reinforcing member to a clothing item. The reinforcing member 600 can include attachment members 610, 620 formed into at least a partial frame around the reinforcing member. The attachment member 610 forms a partial frame around the reinforcing member 600. In FIG. 6A, the attachment member 610 covers the perimeter of the reinforcing member 600. However, the attachment member 610 can only partially surround the perimeter of the reinforcing member 600. For example, sides 612, 614 can be optional. The attachment member 620 in FIG. 6B forms a full frame around the reinforcing member 600. The frame defined by attachment members 610, 620 can enable attachment to the clothing item by, for example, gluing the attachment members 610, 620 to the clothing item.

The attachment members 610, 620 can define multiple holes 630, 640 (only 2 labeled for brevity) enabling attaching the reinforcing member 600 to the clothing item. The holes can be laid out in various patterns, such as shown in FIGS. 6A-6B. The attachment can include sewing through the multiple holes 630, 640, or the attachment can include snapping on the reinforcing member 600 using the holes 630, 640 to a corresponding protrusion on the clothing item. The reinforcing member 600 can attach to and support the wearable ID using a hook and loop mechanism.

Figure 7:
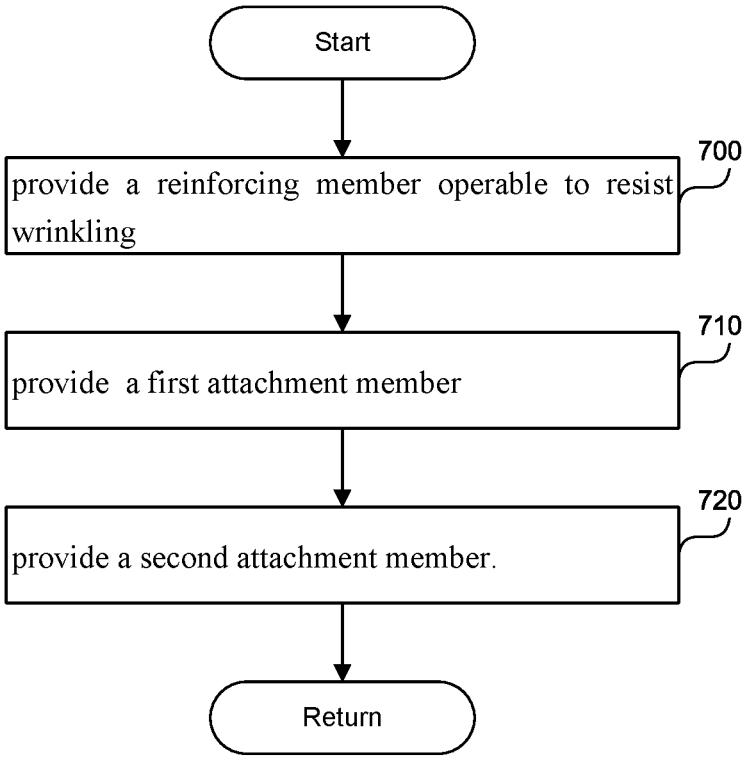
FIG. 7 is a flowchart of a method to manufacture a reinforcing member.

FIG. 7 is a flowchart of a method to manufacture a reinforcing member. In step 700, a reinforcing member is provided. The reinforcing member 100's idealized flexural rigidity of 9.5900 kN-mm^2 provides a unique combination of flexibility and rigidness to be strong enough to resist wrinkling of the wearable ID 130, but also allow flexibility for user comfort. The reinforcing member can be created using additive manufacturing and/or injection molding. The printing filament can include a fire-resistant material, a polylactic acid (PLA), a polycarbonate, and/or a thermoplastic material that meets the UL-94 standards for fire retardant materials, such as the V-0 standards.

In step 710, a first attachment member is provided. The first attachment member can be integrated onto a side of the reinforcing member, can be internal to the reinforcing member, or can be attached to the reinforcing member using a detachable or permanent mechanism such as a glue. The first attachment member can form a first attachment when in contact with a first attachment member receptor and can support or resist a vertical force of up to 44 N. For example, the first attachment member can be a hook-and-loop hook, while the first attachment member receptor can be a hook-and-loop loop. In another example, the first attachment can be a magnet or a ferromagnetic material, while the second attachment member can be attracted to the magnet or the ferromagnetic material.

In step 720, a second attachment member is provided. The first attachment member can be integrated onto a side of the reinforcing member, can be internal to the reinforcing member, or can be attached to the reinforcing member using a detachable or permanent mechanism such as a glue. The second attachment member can attach to a second attachment member receptor and support or resist a vertical force of up to 44 N. The second attachment member can be a hook-and-loop loop, while the second attachment receptor can be a hook-and-loop hook. The second attachment member can provide an area, such as flaps, to attach to a clothing item by sewing, gluing and/or snapping on. The second attachment can also be a magnet or a ferromagnetic material.

The reinforcing structure, such as an infill can be created that defines indentations and protrusions. The reinforcing structure can be internal to the reinforcing member or can be on the surface of the reinforcing member. The more protrusions, the higher the strength, while the more indentations, the less material is required to manufacture the reinforcing member. The reinforcing structure can be shaped in a crisscross pattern, as shown in FIG. 5, or can be shaped into a concentric pattern, triangles, quadrilaterals, pentagrams, hexagons, etc. The reinforcing structure can be created using additive manufacturing and/or injection molding as an integral part of the reinforcing member, or the reinforcing structure can be printed separately from the reinforcing member and can be attached to the reinforcing member.

The first attachment member can also be printed as an integral part of the reinforcing member or can be printed separately from the reinforcing member and can be attached to the reinforcing member using an attachment such as glue.

The second attachment member can be formed into at least a partial frame around the reinforcing member, as shown in FIGS. 6A-6B. The second attachment member can be printed as an integral part of the reinforcing member or can be printed separately and attach the reinforcing member. An attachment between the second attachment member and the clothing item, such as the uniform, can be formed. The attachment can be detachable, such as a snap-on attachment. The attachment can be permanent, for example by sewing the second attachment member into the clothing item.

Remarks

The language used in the specification has been principally selected for readability and instructional purposes, and it may not have been selected to delineate or circumscribe the inventive subject matter. It is therefore intended that the scope of the invention be limited not by this Detailed Description, but rather by any claims that issue on an application based hereon. Accordingly, the disclosure of various embodiments is intended to be illustrative, but not limiting, of the scope of the embodiments, which is set forth in the following claims.

The invention claimed is:

1. An interface, comprising:

a planar interface member composed of a fire retardant material and having a first attachment surface for temporary mating engagement with a garment and a second attachment surface, opposite the first attachment surface, adapted for temporary mating engagement with a label, a perimeter of the planar interface member adapted to be substantially coincident with a label perimeter, the planar interface member having a thickness between 0.6 mm and 2 mm;

wherein the planar interface member is adapted to be interposed between the label and the garment to detachably and rigidly secure the label to the garment, the planar interface member comprising a reinforcing pattern defining indentations and protrusions.

2. The interface of claim 1, the first attachment surface and the second attachment surface comprising a hook-and-loop hook and a hook-and-loop loop.

3. The interface of claim 1, wherein the label and the garment comprise an attachment mechanism for temporary mating engagement, one with the other.

4. A system comprising:

a reinforcing member having a flexural rigidity, providing rigidness to resist wrinkling of a wearable ID attached to the reinforcing member, and providing flexibility for wearer's comfort, the reinforcing member comprising a reinforcing pattern defining indentations and protrusions;

a first attachment member forming a first attachment when in contact with a first attachment member receptor, the first attachment capable of supporting or resisting a vertical force;

a second attachment member forming a second attachment in contact with a second attachment member receptor, the second attachment capable of supporting or resisting the vertical force; and the first attachment member and the second attachment member comprising a hook-and-loop hook and a hook-and-loop loop.

5. The system of claim 4, the first attachment member and the second attachment member in contact with each other form an attachment mechanism capable of supporting or resisting the vertical force of up to 44 N.

6. The system of claim 4, the reinforcing member comprising a fire-resistant thermoplastic material.

7. The system of claim 4, comprising the second attachment member formed into at least a partial frame around the reinforcing member.

8. The system of claim 7, the partial frame around the reinforcing member enabling a permanent attachment to a clothing item.

9. The system of claim 8, the permanent attachment comprising a glue between the partial frame and the clothing item.

10. The system of claim 7, the partial frame defining a plurality of holes to enable attaching the reinforcing member to the clothing item.

11. The system of claim 4, the first attachment member comprising a magnet, a protrusion, or an indentation.

12. The system of claim 4, comprising:

the reinforcing member having the flexural rigidity of 9.5900 kN-mm^2;

the first attachment capable of supporting or resisting the vertical force of up to 44 N; and the second attachment capable of supporting or resisting the vertical force of up to 44 N.

13. A method comprising:

providing a reinforcing member having a flexural rigidity, providing rigidness to resist wrinkling of a wearable ID attached to the reinforcing member, and providing flexibility for wearer's comfort, said providing the reinforcing member comprising printing, by a 3D printer, of the reinforcing member;

providing a first attachment member forming a first attachment when in contact with a first attachment member receptor, the first attachment capable of supporting or resisting a vertical force;

providing a second attachment member forming a second attachment in contact with a second attachment member receptor, the second attachment capable of supporting or resisting the vertical force; and wherein the first attachment member and the second attachment member comprise a hook-and-loop hook and a hook-and-loop loop.

14. The method of claim 13, comprising creating a reinforcing structure defining indentations and protrusions.

15. The method of claim 14, comprising forming the reinforcing structure on a surface of the reinforcing member.

16. The method of claim 13, comprising attaching the first attachment member to the reinforcing member.

17. The method of claim 13, comprising forming the second attachment member into at least a partial frame around the reinforcing member.

18. The method of claim 13, comprising forming a detachable attachment between the second attachment member and a clothing item.

* * * * *